United States Patent [19]

Jones et al.

[11] 4,395,832

[45] Aug. 2, 1983

[54] GAS DUCT ARRANGEMENT FOR A VACUUM FURNACE

[75] Inventors: William R. Jones, Chalfont; Fred W. Ripley, Perkasie, both of Pa.

[73] Assignee: Vacuum Furnace System Corporation, Souderton, Pa.

[21] Appl. No.: 222,149

[22] Filed: Jan. 2, 1981

[51] Int. Cl.[3] ..... F26B 17/10

[52] U.S. Cl. ..... 34/233; 432/77; 432/66

[58] Field of Search ..... 432/77; 34/133, 63, 34/66, 225, 233, 135, 136, 137; 220/4 F; 217/12 R

[56] References Cited

U.S. PATENT DOCUMENTS

| | | | |
|---|---|---|---|
| 55,061 | 5/1866 | Clement | 217/12 R |
| 1,698,313 | 1/1929 | Luther | 34/135 |
| 2,132,709 | 10/1938 | Vanderwerp | 34/63 |
| 3,222,800 | 12/1965 | Siegel et al. | 34/233 |
| 3,309,835 | 3/1967 | Peppler | 53/557 |
| 3,805,408 | 4/1974 | Shadley | 34/133 |
| 4,259,088 | 3/1981 | Moss | 34/57 A |

*Primary Examiner*—Larry I. Schwartz
*Attorney, Agent, or Firm*—William E. Cleaver

[57] ABSTRACT

The present invention is a duct arrangement for use with a vacuum furnace to permit inert gas to be supplied continuously to the hot zone enclosure of a vacuum furnace. The novel duct arrangement includes a plenum means that, in the preferred embodiment, is formed so that its inside wall is the outer wall of the hot zone enclosure and which is disposed to be wrapped around 95% of the hot zone enclosure (within the vacuum chamber) with which it is employed. The plenum is sealed at both ends and is formed to have a plurality of holes in the common wall of the hot zone enclosure and the plenum. Into each of said holes there is fitted a removable nozzle member. A relatively large hole is formed in the outside wall of the plenum to permit inert gas to be fed into the plenum and through the nozzles into the hot zone enclosure to cool the work piece therein.

5 Claims, 4 Drawing Figures

GAS DUCT ARRANGEMENT FOR A VACUUM FURNACE

BACKGROUND

It is well understood in the vacuum furnace art that a "piece" or "work piece", which has been subjected to the high temperatures of the furnace, should be cooled in some positive way and that such a positive technique is the cooling or quenching of the hot work piece in an atmosphere of an inert gas such as nitrogen or argon. The hot work piece is normally not cooled in air because it is usually desirable that oxidation not take place. Hence an inert gas such as nitrogen is used. It becomes apparent that if relatively rapid cooling is desired, then the inert gas should be continuously passed over and in contact with the hot work piece, to remove heat, and then purged from the hot zone enclosure and replaced by cooled inert gas which in turn will remove further heat from the work piece.

In the prior art this technique has been accomplished by designing and employing steel pipes which are fitted and mounted around the outside periphery of the hot zone enclosure. Such pipes are further formed to have offshoots, or protrusions, which are fitted through holes in the outside wall of the hot zone enclosure. It has generally been the practice, in the prior art, to employ more than one such pipe with a hot zone enclosure and the plurality of offshoots or smaller pipes form a plurality of inlet members within the hot zone enclosure. With this arrangement, in the prior art, inert gas is fed into the main pipes, through the offshoot pipes, into the hot zone enclosure to surround the hot work piece. This prior art arrangement has worked satisfactorily for the most part but has created problems when the need for maintenance arises. As the maintenance problems were carefully studied it was discovered that not only could they be solved but that an improved means for providing inert gas would also result.

In the prior art, as mentioned above, the main pipes are mounted through suitable brackets or otherwise to the hot zone enclosure. If the hot zone enclosure has to be removed for repairs, it becomes necessary to first remove the pipes in order to remove the hot zone enclosure from the furnace chamber. The pipes and in particular the offshoot pipes are awkward to handle and very often because they become brittle, with constant expansion and contraction, they tend to break. If an offshoot pipe breaks, it means that the entire assembly has to be removed because the offshoot pipes are made integral with the main pipe assembly. In addition the mounting structure per se is awkward to handle.

Besides the awkwardness and capacity for breakage, it is well understood that there are pressure losses through such pipe systems and hence the distribution of the gas into the hot zone enclosure is non uniform.

The present gas duct arrangement eliminates any necessity to remove any duct-like structure if it becomes necessary to remove the hot zone enclosure. In addition the present gas duct arrangement enables the system to provide a uniform distribution of the quenching gas in the hot zone enclosure and enables a lower operating gas pressure than in the prior art.

SUMMARY OF THE INVENTION

The present duct arrangement is effected by securing, through welding or the like, to the outer wall of a hot zone enclosure, a pair of side wall pieces each having a groove, or a race, formed therein. The two side wall pieces constitute the sidewalls of a plenum, which is made up of the outer wall of the hot zone enclosure, the two side wall pieces and an upper wall. The upper wall, or outside wall in the preferred embodiment, comprises a sheet metal element that slides into the grooves in the side wall pieces and which is approximately the width of the outer wall of the hot zone enclosure. The sheet metal piece, in the preferred embodiment wraps around 95% of the circumference of the hot zone enclosure and there is a blocking, or sealing, member at each end of the plenum to form a sealed chamber. The blocking members are secured to the sheet metal member and the side walls by welding, or the like, and are secured to the outer wall of the hot zone enclosure by bolts or other suitable securing means.

The common wall of the plenum and the outer wall of the hot zone enclosure has a plurality of holes cut therein. Through each hole, in the preferred embodiment, there is located a molybdenum pipe piece which is threaded on one end. The threaded section is located on both sides of the common wall and a lock nut on each side is threaded along the pipe toward the common wall to secure the pipe to the common wall. Other means could be employed to secure the pipes in the holes of the common wall. In the sheet metal member of the plenum there is formed a hole to which an input gas pipe is attached to permit inert gas to be passed into the plenum, through the molybdenum pipes into the hot zone enclosure. When the hot zone enclosure must be removed for maintenance the input gas pipe is the only part which needs to be removed since the plenum becomes integral with the hot zone enclosure.

The objects and features of the present invention will become better understood from the following description, taken in conjunction with the drawings in which.

Figure 1:
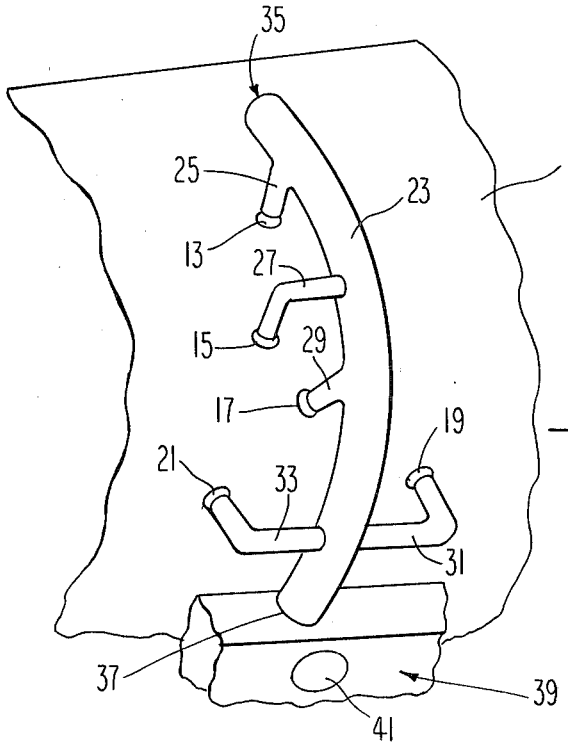
PRIOR ART Fig. 1
FIG. 1 is a pictorial, schematic partial assembly of the prior art duct means to provide inert gas to a hot zone enclosure.

Let us consider FIG. 1 which depicts the steel pipe with offshoot pipes presently used in the prior art. In FIG. 1 there is shown a section 11 of the outside wall of a hot zone enclosure. Note that in the section 11 there are formed five holes 13, 15, 17, 19 and 21. As also can be seen in FIG. 1, there is a main pipe 23 with offshoot pipes 25, 27, 29, 31 and 33 formed integrally therewith. The main pipe 23 is sealed off at end 35, while open end 37 is fitted into a manifold means 39. In the prior art the practice is to locate six or more main pipes in parallel and mounted by some method in close proximity to the wall 11 of the hot zone enclosure. With respect to each such main pipe, its offshoots are each located through an associated hole. For instance as can be understood from FIG. 1, offshoot pipe 25 passes through hole 13, offshoot pipe 27 passes through hole 15, offshoot pipe 29 passes through hole 17, offshoot pipe 31 passes through hole 19, and offshoot pipe 33 passes through hole 21. The open ends of such main pipes are connected into a manifold means such as manifold means 39. The inert gas is fed from a large duct, not shown, in response to a rotary pump, or the like, through the hole 41 and on through the main pipes and offshoot pipes into the hot zone enclosure.

In the hot zone enclosure there always exists a plurality of heating elements, heating element holders as well as the spouts or pipes just described. Due to the stresses created in such members by the constant change of temperature these members become brittle and rupture. A broken member of course has to be repaired and often it is necessary to remove the hot zone enclosure to make such repairs.

It has been found that the removal of the main pipe in the prior art, such as pipe 23, with all the offshoot pipes is difficult and time consuming. Even more serious than the foregoing is the fact that the offshoot pipes per se become brittle and in removing the pipe assembly the offshoot pipes often break which mandates that the entire pipe assembly must be replaced. In addition because of the configuration of the pipe assembly there are pressure losses as gases pass therethrough and such losses result in an uneven distribution of gases into the hot zone chamber.

Figure 2:
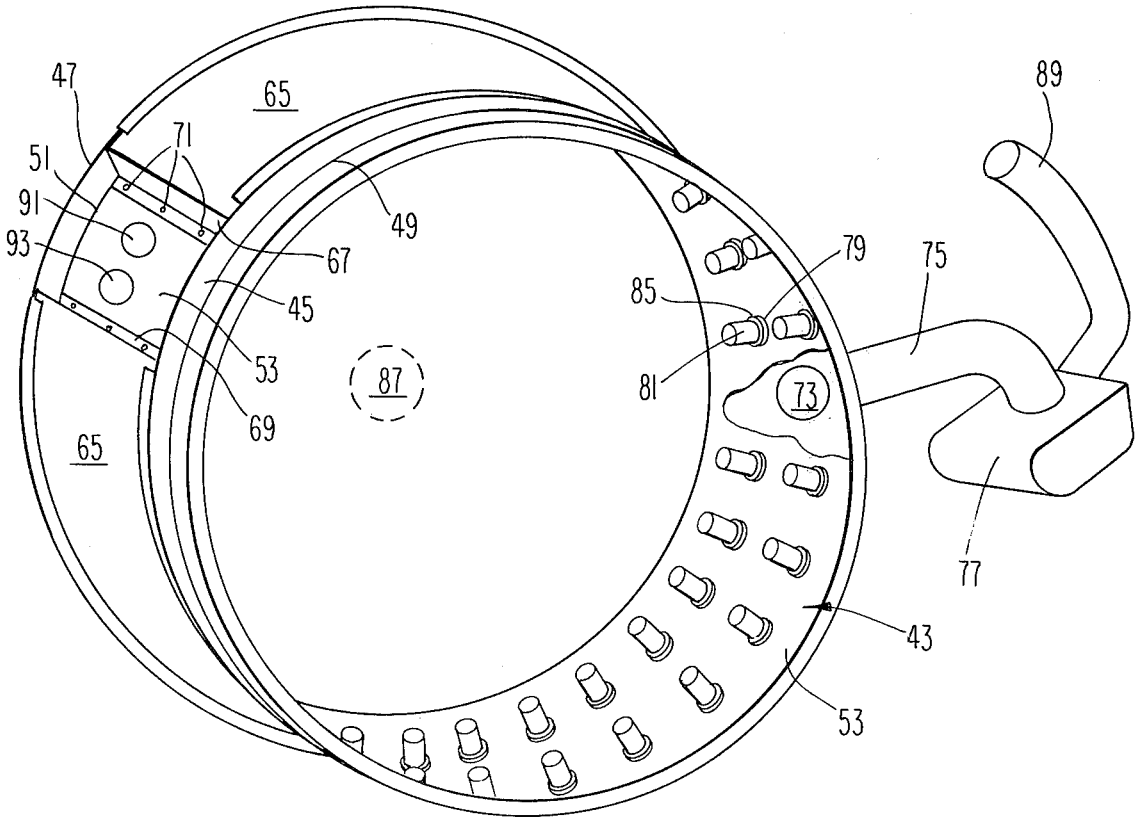
FIG. 2 is a pictorial view of a hot zone enclosure with the present plenum made a part thereof and which depicts the molybdenum pipes disposed through the outer wall of the hot enclosure.

If we examine FIG. 2 we note a hot zone enclosure 43 to which there are secured two side wall members 45 and 47. In the preferred embodiment the side wall members 45 and 47 are welded along the joints 49 and 51 to the outer wall 53 of the hot zone enclosure. The side wall members 45 and 47 have grooves formed therein and such grooves can be better appreciated from FIG. 3.

Figure 3:
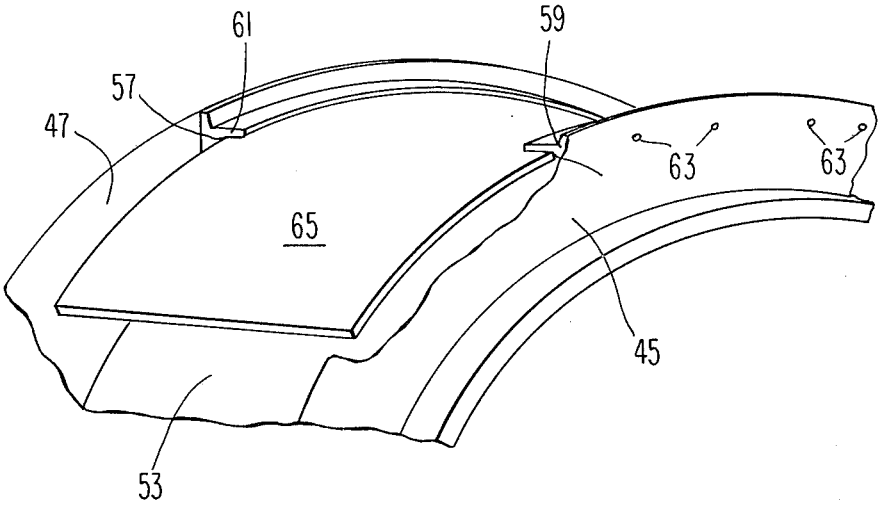
FIG. 3 is an enlarged view of the sheet metal member being slipped into the grooves of the side walls of the plenum.

Note in FIG. 3 that the grooves 55 and 57 are formed by having separate groove members 59 and 61 secured to the side walls 45 and 47, (by the rivets or bolts 63 for side wall 45 and similar means with respect to the side wall 47). It should be understood that the grooves can be formed from the side walls per se.

If we examine FIG. 3 further we can note that there is a large piece of sheet metal 65 being slipped into the grooves 55 and 57. In FIG. 3, the piece of sheet metal 65 is shown before it has been fully slipped into the grooves 55 and 57 (or before it has been cut off as the case may be) and is shown to be approximately the width of the outer wall 53. It should be understood that when the sheet metal 65 is slipped into the grooves 55 and 57 there is a seal formed against gas leakage. As can be gleaned from FIG. 2 the sheet metal piece 65 is long enough to pass around 95% of the circumference of the hot zone enclosure 43. As can be recognized from FIGS. 2 and 3, if the sheet metal piece 65 were located in the grooves 55 and 57 and nothing more were added to the structure, then there would be an open ended (or two ends) duct located on the outer wall of the hot zone enclosure 43. Since the purpose of the sheet metal, in combination with the side walls and the outer wall of the hot zone enclosure, is to form a plenum into which inert gas will be pumped to ultimately be led or fed into the hot zone enclosure, it becomes apparent that the open ended duct must be sealed.

In the preferred embodiment (FIG. 2) two smaller pieces of sheet metal 67 and 69 are secured to the sheet metal piece 65, to the side wall members 45 and 47 and to the outer wall 53 of the hot zone chamber 43. The sheet metal pieces 67 and 69 are secured by welding or the like or through bolts such as bolts 71 shown in FIG. 2. The sheet metal pieces 67 and 69 can be secured in any number of ways but they must be secured to seal the ends of the duct formed by the sheet metal piece 65, side walls 45 and 47 and outer wall 53.

Figure 4:
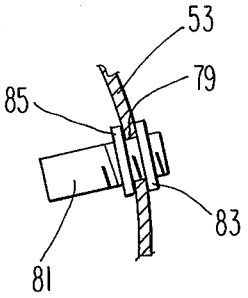
FIG. 4 shows a pipe fitting through the common wall and secured by two lock nuts.

As can be gleaned from FIG. 2, sheet metal piece 65 has a hole 73 cut therein. Fitted into hole 73 is a pipe 75 which in turn is fitted to an inert gas reservoir 77. The reservor 77 (which can be a tank of gas and a blower means) is equipped with a pump device to force gas into the plenum just described. In order for the inert gas, which is forced into plenum, to pass into hot zone enclosure 43 there must be openings in the common wall 53. As can be seen in FIG. 2 a plurality of holes, such as hole 79, are formed in the common wall 53. Into each such hole there is fitted a pipe, such as pipe 81 shown in FIGS. 2 and 4. Each pipe is fitted to pass into the hot zone enclosure and is secured to the common wall 53 by a pair of lock nuts, such as lock nuts 83 and 85. If a repair is necessary to a pipe, the seals on the plenum are removed the sheet metal overlay is moved along to the position which exposes the pipe to be repaired and the pipe can be removed. In another version, the lock nut 83 is secured to the common wall 53 and the nut 85 is loosened to permit the damaged pipe to be unthreaded out of the common wall and replaced.

The system works such that, when a hot work piece, (located within the hot zone chamber), is no longer to be subjected to heat and should be cooled, inert gas is pumped from the reservoir 77, through pipe 75, into the plenum, out the pipes (such as pipe 81), into the hot zone enclosure 43. Such inert gas comes in contact with the hot work piece and removes heat therefrom. The heated inert gas is pumped out from the rear of the furnace enclosure through a baffled hole 87, shown in phanthom and is passed through a gas to water heat exchanger to pipe 89. The inert gas is cooled in the heat exchanger and returned to the inert gas reservoir 77. Meantime cool, inert gas has been passing in contact with the hot work piece to continually cool that work piece.

The two holes 91 and 93 (FIG. 2), formed in common wall 53 are provided to permit the electric cables which are necessary to supply power, to pass therethrough.

The plenum described above has a number of advantages. The advantages which arise because it is integral with the hot zone enclosure and which therefore mitigate troubles during repairs have already been described. It should also be noted, however, that the plenum, because of its large cross section configuration does not generate pressure losses of the magnitude experienced with prior art devices. Hence the distribution of the inert gases entering the hot zone enclosure is relatively uniform and this is desirable, particularly when the work piece fills any substantial part of the hot zone enclosure. In addition the fact that the plenum uses a common wall with the hot zone enclosure enables the inert gases to absorb some heat from the enclosure wall while passing therealong and before passing through the pipes into the hot zone enclosure. Such an "early time" heat absorption reduces the overall cooling cycle.

I claim:

1. A gas duct arrangement for use with a hot zone chamber of a vacuum furnace, wherein said gas duct and said hot chamber when used are located within a vacuum furnace and subjected to repeated cycles of expansion and contraction due to heating and cooling within said vacuum furnace and wherein said hot zone chamber has an outer wall, comprising in combination: plenum means having an outside wall, two side walls and an inside wall, said outside wall and said inside wall being of substantially the width of said outer wall, said plenum means formed and disposed to fit substantially completely in width and length around said outer wall of said hot zone chamber with said inside wall of said plenum being formed integral with said outer wall of said hot zone chamber; a plurality of apertures, each formed to pass from the inside of said hot zone chamber, through said outer wall thereof, through said inside wall of said plenum means thereby opening into said plenum means; a plurality of pipe means formed independently of the plenum and with each disposed to respectively pass through an associated one of said plurality of apertures and each formed to be threaded and disposed to be in threaded engagement at its associated aperture so as to be independently removable from its associated aperture, said pipe means further formed and disposed to direct gas into said hot zone in a direction substantially axial to its associated aperture; and input aperture means formed in said outside walls of said plenum means whereby gas can pass into said plenum means and therefrom through said plurality of pipe means into said hot zone chamber.

2. A gas duct arrangement according to claim 1 wherein said two side walls are secured to said outer wall of said hot zone chamber and disposed substantially around the outside perimeter thereof and wherein said outside wall of said plenum is secured to said two side walls and of substantially the same length as said side walls and wherein there is included means to seal said side walls to said outside wall of said plenum and to said outer wall of said hot zone chamber to prevent ambient gas in said vacuum furnace from passing into said plenum.

3. A gas duct arrangement according to claim 1 wherein each of said apertures per se is formed unthreaded and wherein at each of said apertures there is provided a threaded means secured to said outer wall to enable an associated threaded pipe means to be secured to said outer wall of said hot zone chamber whereby each of said pipe means can be independently removed or added from and to said outer wall.

4. A gas duct arrangement according to claim 2 wherein said two side walls are formed to each have a groove therein and wherein said outside wall has been located within said grooves.

5. A gas duct arrangement according to claim 2 wherein said means to seal includes two sheet metal pieces formed to fit into two open ends of said plenum when said plenum does not extend 100% around the outside perimeter of said hot zone chamber.

* * * * *